United States Patent [19]

Stenger

[11] Patent Number: 5,025,955

[45] Date of Patent: Jun. 25, 1991

[54] CONTAINER CLOSURE WITH IMPROVED SEALING MEMBRANE

[75] Inventor: Tracy K. Stenger, Rockford, Ill.

[73] Assignee: Johnson Enterprises, Inc., Rockford, Ill.

[21] Appl. No.: 553,560

[22] Filed: Jul. 16, 1990

[51] Int. Cl.[5] ..... B67D 1/12

[52] U.S. Cl. ..... 222/82; 222/400.8

[58] Field of Search ..... 222/400.7, 400.8, 82, 222/85, 81, 397; 251/149.2; 137/73, 67, 68.1; 285/3, 4, 137.1

[56] References Cited

U.S. PATENT DOCUMENTS

| | | | |
|---|---|---|---|
| 3,240,392 | 3/1966 | Nicko | 222/82 R |
| 3,410,456 | 11/1968 | Johnson, Jr. et al. | 222/82 |
| 3,592,351 | 7/1971 | Johnson, Jr. | 220/27 |
| 3,823,848 | 7/1974 | Schuster et al. | 222/82 R |
| 4,000,829 | 1/1977 | Johnson, Jr. et al. | 220/265 |
| 4,436,227 | 3/1984 | Johnson, Jr. et al. | 222/400.8 X |
| 4,700,861 | 10/1987 | Neward | 222/481 X |
| 4,784,299 | 11/1988 | Stenger | 222/400.7 X |

*Primary Examiner*—Michael S. Huppert
*Assistant Examiner*—Anthoula Pomrening
*Attorney, Agent, or Firm*—Leydig, Voit & Mayer, Ltd.

[57] ABSTRACT

A closure for a container such as a container of draft beer includes two sealing plugs having bores for receiving the gas and beer tubes of a tapping unit. Initially, the bores of the plugs are sealed by rubber membranes which are adapted to be pierced by the tubes as an incident to tapping the container. The bores and the membranes are constructed so as (A) to effect piercing of the membranes with a controlled tear so as to avoid punched-out rubber slugs, (B) to eliminate the need of flappers for re-sealing the bores, and (C) to reseal the container at moderate pressures while enabling venting of the container at extremely low and high pressures.

9 Claims, 2 Drawing Sheets

Fig. 3.

CONTAINER CLOSURE WITH IMPROVED SEALING MEMBRANE

BACKGROUND OF THE INVENTION

This invention relates to a closure for sealing a container of draft beer or the like and for coacting with a tap for dispensing beer from the container. More particularly, the invention relates to a closure of the same general type as disclosed in Johnson, Jr. et al U.S. Pat. No. 3,410,456 and Johnson, Jr. et al U.S. Pat. No. 4,000,829.

The closures disclosed in those patents each includes a sealing plug molded of rubber or the like and formed with a central bore which receives a tapping tube for introducing pressurized gas into or withdrawing a beverage from the container. The lower end of the bore initially is sealed by a thin rubber membrane which overlies a hinged rubber flapper. As the tube is inserted into the bore, it pierces the membrane and swings the flapper downwardly. The membrane folds downwardly along and seals against the tube to prevent the beverage from escaping from the container along the outer side of the tube. When the tube is withdrawn, the hinged flapper swings upwardly and seals off the punctured membrane.

While closures of the foregoing type have enjoyed considerable commercial success, they are not without problems. One problem results from the fact that a slug of rubber is sometimes punched out of the membrane when the latter is punctured. The slug falls into the container and creates an unsightly appearance.

A second problem presented by the prior closures is that the flapper may re-seal the container too tightly after the tap has been removed from the container. If the closure is used to seal a disposable container made of P.E.T. or the like, the flappers of the prior closures establish such a tight seal that the container may burst at abnormally high pressures rather than relieving the pressure through the closure. Also, the prior closures are not capable of venting a nearly empty disposable container. If such a container is left in a lowly pressurized condition, heat (e.g., direct sunlight) could increase the pressure to such a high magnitude as to cause the container to burst.

The flappers of the prior closures also add to the cost thereof. After such a closure has been molded, it is necessary to perform a slicing operation on the lower end portion of the closure to separate the flapper from the membrane. In addition to the cost involved in the slicing operation, rigorous inspection procedures are necessary to insure that the membrane has remained intact after the slicing operation.

SUMMARY OF THE INVENTION

The primary aim of the present invention is to provide a new and improved closure of the above general type which adequately seals the container while virtually eliminating the presence of punched-out slugs, while eliminating the expense attendant to the flapper and while being capable of venting the container under conditions of low pressure and extremely high pressure.

A more detailed object of the invention is to achieve the foregoing through the provision of a closure in which the flapper is eliminated and in which the bore of the closure is uniquely shaped to reinforce the membrane prior to puncturing thereof and to seal against the tube after the membrane has been punctured. The membrane is shaped to tear along a well-defined line and to hinge downwardly alongside the tube so as to virtually eliminate punched-out slugs. After the tube has been withdrawn from the container, the membrane re-seals against the bore of the closure if moderate pressure remains in the container but vents the container to atmosphere if the internal pressure is either very high or very low.

These and other objects and advantages of the invention will become more apparent from the following detailed description when taken in conjunction with the accompanying drawings.

DETAILED DESCRIPTION OF THE PREFERRED EMBODIMENT

Figure 1:
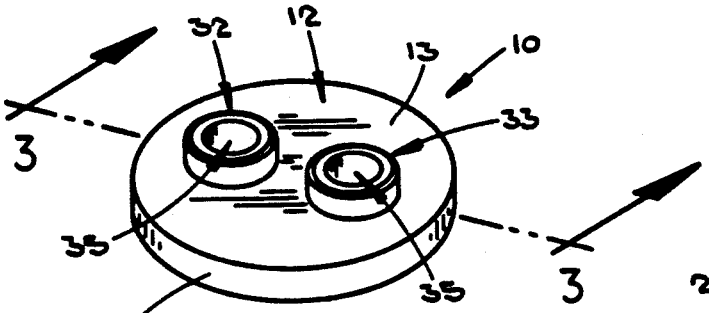
FIG. 1 is a perspective view of a new and improved closure incorporating the unique features of the present invention.

In many respects, the closure 10 of the present invention is similar to that disclosed in Johnson, Jr. et al U.S. Pat. No. 4,000,829. The closure comprises a metal overcap 12 having a top plate 13 and a depending skirt 14. The overcap is adapted to be placed over the neck 15 (FIG. 5) of a container 16 and the skirt is adapted to be crimped beneath a lip 17 on the neck in order to hold the overcap securely on the neck. In this particular instance, the container 16 is a disposable container made of polyethylene terephthalate or other plastic-like material. Specifically, the container may be a spherical container of the type sold by the assignee of the present invention under the trademark BEER SPHERE.

Figure 2:
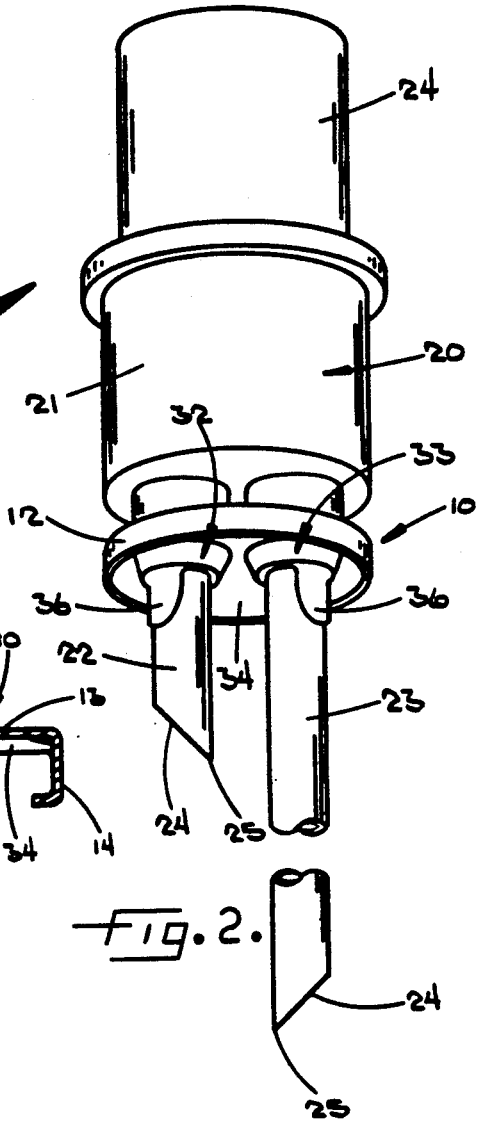
FIG. 2 is a perspective view showing a typical dispensing tap in conjunction with the closure.

The closure 10 is designed for use with a dispensing pump/tap unit 20 (FIG. 2) which may be similar to that disclosed in Johnson, Jr. et al U.S. Pat. No. 4,436,227. The unit 20 includes a body 21 molded of plastic and adapted to be connected to a product dispensing line such as a beer line (not shown). Depending from and spaced diametrically around the body are a gas tube 22 and a beer tube 23. In response to operation of a hand pump 24 at the top of the body, pressurized air is introduced into the container 16 through the gas tube 22 and causes beer to flow from the container and to the beer line via the beer tube 23.

Both tubes 22 and 23 are cylindrical and the lower end portion of each tube is beveled on an acute angle as indicated at 24 so as to form a point 25 on one side of the tube at the lower end thereof. As shown most clearly in FIG. 2, the points 25 are formed on adjacent sides of the two tubes. The gas tube 22 is comparatively short and projects just a short distance into the upper end portion of the container 16 while the beer tube 23 is significantly longer and extends nearly to the bottom of the container.

In addition to the overcap 12, the closure 10 includes a pair of sealing plugs 32 and 33 located within holes in the top plate 13 of the overcap and adapted to receive the tubes 22 and 23, respectively, of the pump/tap unit 20. The sealing plugs are made of rubber and are molded integrally with a disc-like gasket 34 (FIGS. 3 and 4) which underlies the top plate 13. When the overcap 12 is installed on the neck 15 of the container 16, the outer peripheral portion of the gasket 34 becomes sandwiched between the top plate 13 and the top of the lip 17 so as to establish a seal between the two.

Each sealing plug 32, 33 is formed with an upwardly opening bore 35 (FIG. 3) whose lower end portion is originally sealed by a radially extending membrane 36 which is molded integrally with the plug. Initially, the membranes seal the container 16 and confine the beer therein. In using the pump/tap unit 20, the latter is positioned such that the tubes 22 and 23 are aligned with the bores 35 of the plugs 32 and 33, respectively. The unit 20 then is thrust downwardly to cause the tubes to enter the bores and to cause the pointed ends 25 of the tubes to pierce the membranes 36. Downward movement of the pump/tap unit is continued until the unit is stopped by the upper ends of the sealing plugs.

In accordance with the present invention, the bore 35 and the membrane 36 of each sealing plug 32, 33 are uniquely constructed so as to enable sealing of the container 16 without need of a hinged flapper beneath the membrane, so as to virtually eliminate the presence of punched-out rubber slugs resulting from piercing of the membrane and so as to enable venting of the container when very high and very low pressure conditions exist in the container after removal of the pump/tap unit 20. By virtue of eliminating the flappers, the closure of the present invention also can be made more economically than prior closures which relied on such flappers.

More specifically, the bore 35 of each sealing plug 32, 33 of the closure 10 of the present invention is formed with a cylindrical upper end section 40 (FIG. 3) having a diameter just slightly greater than the diameter (e.g., ⅜") of the tubes 22 and 23. Thus, the cylindrical upper end sections 40 of the bores 35 receive the tubes with a snug but slidable fit.

Pursuant to the invention, the bore 35 of each plug 32, 33 is formed with a downwardly tapered and generally frustoconical section 41 (FIG. 3) at the lower end of the cylindrical section 40. The frustoconical section 41 tapers at an angle of about 30 degrees and has a relaxed inner diameter of about 0.300". Immediately below the downwardly tapered section 41, each bore 35 is formed with a downwardly flared and generally frustoconical section 42 which flares at an angle of approximately 45 degrees to a maximum diameter of about ½". A short cylindrical section 43 preferably but not necessarily is located immediately below the downwardly flared section 42 and defines the extreme lower end of the plug 32, 33.

Further in carrying out the invention, the membrane 36 of each plug 32, 33 is joined to the bore 35 at the lower end of the downwardly flared section 42. At the junction of the downwardly flared section 42 with the periphery of the membrane 36, the latter is relatively thin and, in this particular instance, has a thickness of about 0.020". The underside of the membrane is flat and planar but the upper side of the membrane is convex and is preferably formed on a spherical radius of about ½" struck from a center lying on the centerline of the bore 35. As a result of the upper side of the membrane 36 being formed on a spherical radius, the membrane gradually increases in thickness as the membrane progresses inwardly from its periphery toward its diametrical center.

Figure 3:
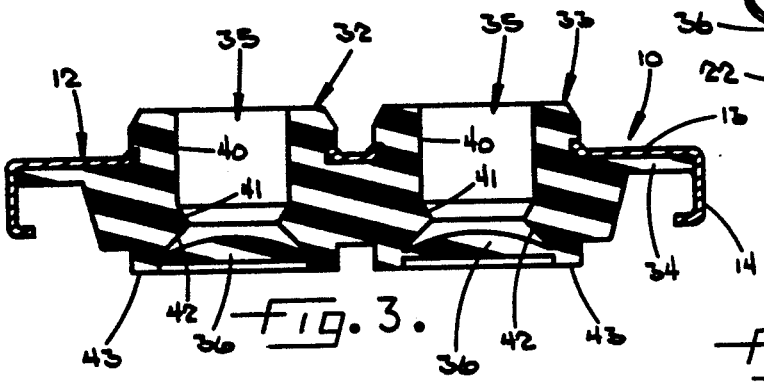
FIG. 3 is an enlarged fragmentary cross-section taken substantially along the line 3—3 of FIG. 1.
Figure 4:
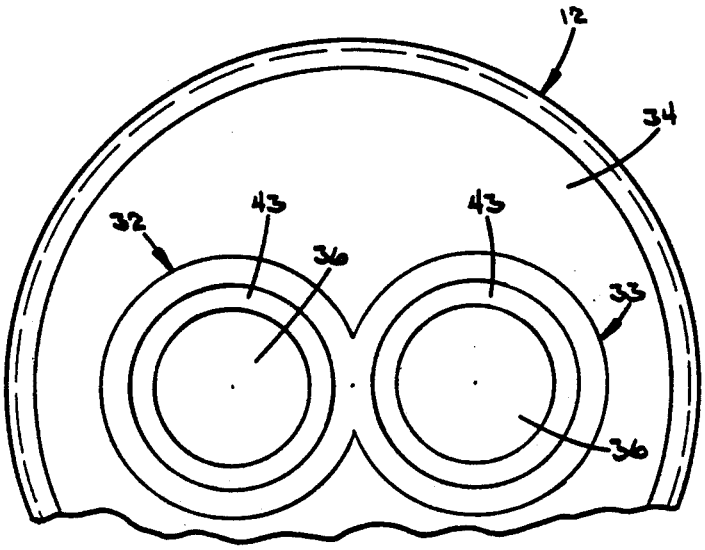
FIG. 4 is a fragmentary bottom plan view of the closure shown in FIG. 3.

FIG. 3 illustrates the closure 10 in its originally molded condition and as the closure appears before application to the container 16 and after application to an unpressurized container. When the closure is in this condition, the lower sides of the membranes 36 are disposed in a generally horizontal plane while the convex upper sides of the membranes are spaced downwardly from the downwardly flared sections 42 of the bores 35.

Figure 5:
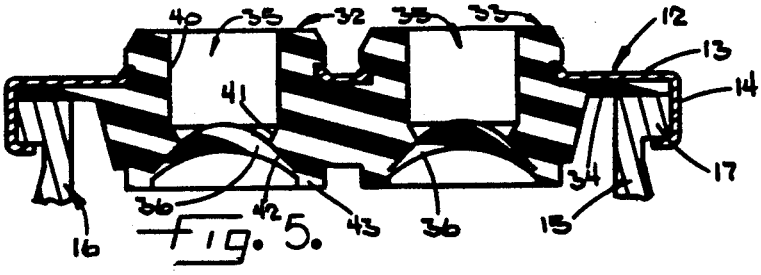
FIG. 5 is a view similar to FIG. 3 but shows the closure applied to a charged container.

When the closure 10 is applied to a container 16 of beer or carbonated beverage, the pressure of the beverage causes the membranes 36 to bulge upwardly into the bores 35 (see FIG. 5). Depending upon the magnitude of the pressure, the peripheral portions of the upper sides of the membranes may bulge upwardly into engagement with the downwardly flared sections 42 of the bores 35 as illustrated in FIG. 5. Under such circumstances, each membrane 36 is backed and reinforced by the overlying downwardly flared bore section 42 and thus, in spite of the relative thinness of the peripheral portion of the membrane, is capable of sustaining a pressure exceeding 70 p.s.i. without tearing or bursting.

Figure 6:
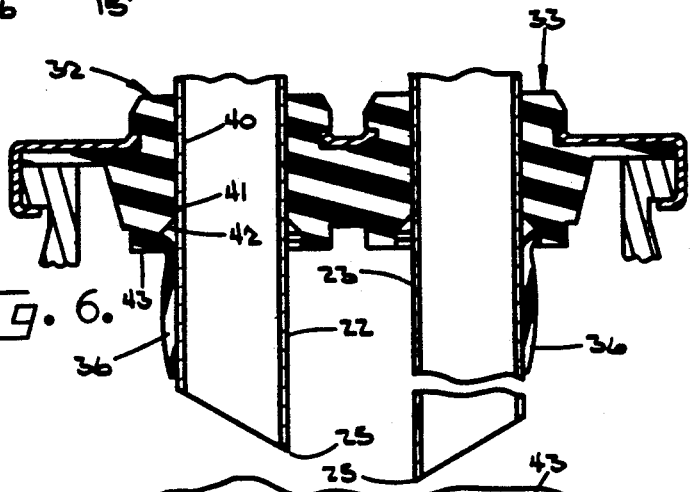
FIG. 6 is a view similar to FIG. 5 but shows the closure after the latter has been tapped by the dispensing tap.
Figure 7:
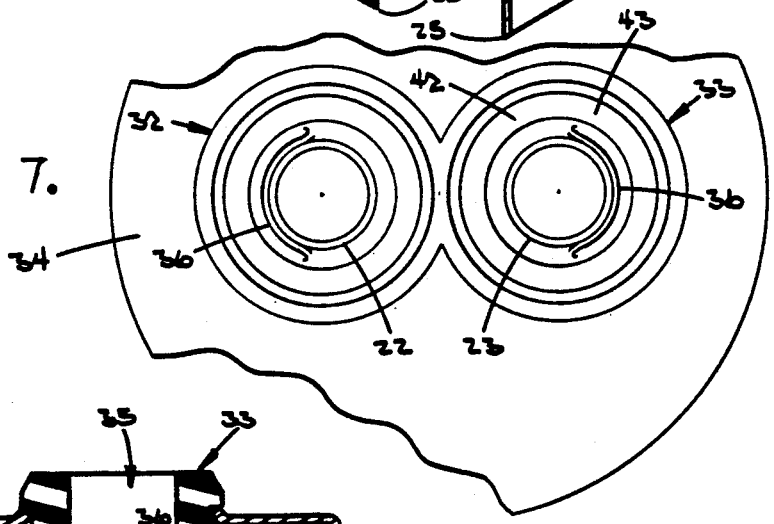
FIG. 7 is a fragmentary bottom plan view of the closure and dispensing tap shown in FIG. 6.

As the container 16 is tapped, the tubes 22 and 23 first slide into the cylindrical sections 40 of the bores 35 and then encounter the downwardly tapered sections 41 thereof. As an incident thereto, the downwardly tapered sections compress radially and resiliently grip the tubes as shown in FIG. 6 so as to establish seals along the outer sides of the tubes and prevent the beer or other beverage in the container from spewing outwardly along the tubes.

As soon as the pointed lower ends of the tubes 22, 23 pass by the downwardly tapered sections 41 of the bores 35, they encounter the upper sides of the membranes 36. Because of the convex shape of the upper sides of the membranes, the thickness of each membrane at a diameter corresponding to the outer diameter of the tube is significantly greater than the thickness of the membrane at the junction of the periphery of the membrane with the downwardly flared section 42 of the bore 35. As a result, the tube does not simply punch through the membrane but instead causes a controlled tear of the membrane along an arc spaced radially outwardly of the tube and at or in proximity to the periphery of the membrane. Due to the bevel 24 at the lower end of the tube, the tear does not extend through a full 360 degrees but instead extends around only about 180 degrees so that the untorn portion of the periphery of the membrane forms a hinge. By virtue thereof, approximately one-half of the periphery of the membrane 36 tears way from the bore 35 and thus the membrane swings downwardly along the outer side of the tube and into the container 16 as shown in FIG. 6. Accordingly, the controlled tearing of the membrane prevents a rubber slug from being punched out of the membrane and eliminates the presence of a loose unsightly slug in the container.

When the container 16 is untapped by withdrawing the tubes 22 and 23 from the bores 35, the membranes 36 re-seal the container to a degree dependent upon the pressure remaining in the container. If the container is empty or nearly empty, the membranes may limply spring back toward their originally molded positions due to the memory of the rubber acting at the hinge region. Under such conditions, the membranes do not re-seal against the downwardly flared sections 42 of the bores 35 and thus the membranes allow any residual pressure in the container to be vented therefrom. This is advantageous in that the vented container is not likely to present an explosion hazard if the container is thrown into a dumpster and subjected to high heat from the sun or another source.

Figure 8:
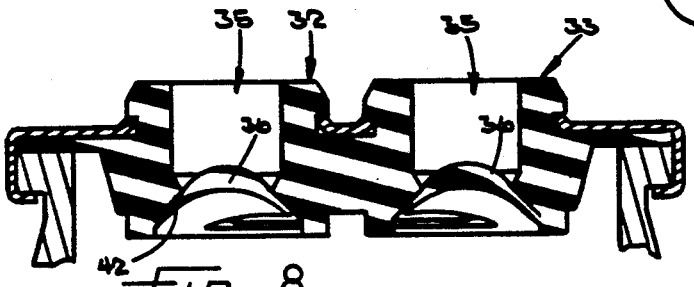
FIG. 8 is a view similar to FIG. 5 but shows the closure after the dispensing tap has been removed and with the container under moderate pressure.

If a substantial quantity of beer remains in the container 16 after removal of the pump/tap unit 20, the pressure of the beer and the pressurized air in the container forces the membranes 36 to swing upwardly and tightly against the downwardly flared sections 42 of the bores 35 as shown in FIG. 8. Thus, the membranes re-seal against the downwardly flared sections and prevent the beer from spewing from the container. On average, the container will re-seal at an internal pressure of 15 p.s.i. If desired, the container may be later re-tapped in order to dispense the remaining beer.

Figure 9:
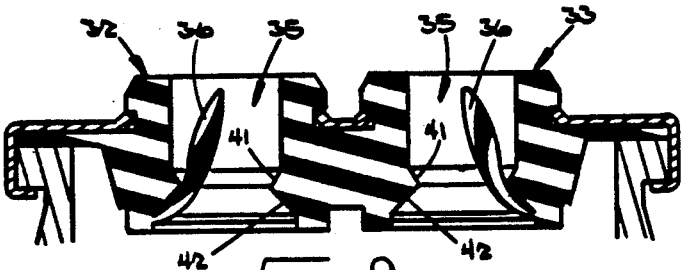
FIG. 9 is also a view similar to FIG. 5 and shows the closure after the dispensing tap has been removed and with the container subsequently having been subjected to high pressure.

By virtue of the re-sealing, the membranes 36 permit disposal of a partially empty container 16 without beer spilling from the container. If the internal pressure of such a container subsequently rises, however, due to heat or the like, such pressure forces one or both torn membranes to flex upwardly past the shoulder defined at the junction of the sections 41 and 42 of the bore 35 (see FIG. 9). As a result, one or both membranes vents the container to atmosphere so as to prevent the container from exploding. On average, the container will vent at a pressure of about 32 p.s.i.

From the foregoing, it will be apparent that the present invention brings to the art a new and improved closure 10 in which the expense of slicing a flapper away from a membrane is eliminated along with the accompanying expense involved in inspecting the membrane to make certain that no damage occurs to the membrane during the slicing operation. The coaction of the uniquely shaped membrane 36 with the uniquely shaped bore 35 eliminates punched-out slugs and effectively seals the container 16 except when extreme high or low pressure conditions dictate that the container should be vented.

In addition to the advantages discussed above, it is believed that the closure 10 of the invention reduces the permeation of air into an untapped container. The membranes 36 have a greater average thickness than prior membranes and, at their thin peripheral portions, the membranes are sealed against and backed by the downwardly flared sections 42 of the bores 35 as shown in FIG. 5. By reducing the ingress of air into the container, oxygen degradation of the beer is decreased so as to increase the shelf life of the product.

While the invention has been disclosed specifically in connection with a closure 10 having two sealing plugs 32 and 33, it should be appreciated that the principles of the invention are applicable to closures having but a single sealing plug. Closures with single sealing plugs are disclosed in Johnson, Jr. et al U.S. Pat. Nos. 3,410,456 and 3,592,351 and can be modified to advantage by utilizing the features of the present invention.

I claim:

1. A seal for use with a container into which a tube is adapted to be inserted for the purpose of withdrawing fluid from the container, said seal comprising a plug made of resiliently yieldable material and adapted to close an opening in the top of the container, a vertically extending bore formed within said plug to permit insertion of the tube into the container through the bore, said bore having an upper end portion and a closed lower end portion, the closed end portion of said bore being defined by a membrane of resiliently yieldable material formed integrally with and extending radially across said bore to seal off the bore and confine the fluid in the container, said membrane being sufficiently thin to tear as an incident to insertion of the tube into the container and being sufficiently flexible to hinge downwardly along the tube interiorly of the container, said bore being of circular cross-section and having a generally cylindrical upper section, having a downwardly tapered and generally frustoconical section adjacent the lower end of said cylindrical section and having a downwardly flared and generally frustoconical section adjacent the lower end of said tapered section, said flared section defining a backing for said membrane when the latter is flexed upwardly by the pressure of said fluid, and said tapered section flexing outwardly and sealing against said tube when the latter is inserted into said bore beyond said cylindrical section.

2. A seal as defined in claim 1 in which said membrane includes an outer periphery joined to said bore adjacent the lower end of said downwardly flared section.

3. A seal as defined in claim 1 in which said membrane includes a central area of predetermined thickness and a peripheral area of lesser thickness.

4. A seal as defined in claim 2 in which the upper side of said membrane is convex, the lower side of said membrane being substantially planar.

5. A seal as defined in claim 4 in which the upper side of said membrane is formed on a spherical radius.

6. The combination of, a walled container for holding a charged beverage and having an opening in the top thereof, a dispensing tap having a tube with a beveled lower end portion whereby a pointed region is defined along one side of the tube at the extreme lower end thereof, and a seal for closing said opening and for admitting said tube into said container for the purpose of withdrawing beverage from the container, said seal comprising a plug made of resiliently yieldable material and adapted to close said opening, a vertically extending bore formed within said plug to permit insertion of the tube into the container through the bore, said bore having an open upper end portion and a closed lower end portion, the closed end portion of said bore being defined by a membrane of resiliently yieldable material formed integrally with and extending radially across said bore to seal off the bore and confine the beverage in the container, said membrane being sufficiently thin to be punctured by said pointed region of said tube as an incident to insertion of the tube into the container and to tear along that side of the membrane adjacent said one side of said tube, said membrane being flexible and swinging downwardly along the opposite side of the tube and interiorly of said container along a hinge line located along the opposite side of the membrane, said bore being of circular cross-section and having a generally cylindrical upper section, having a downwardly tapered and generally frustoconical section adjacent the lower end of said cylindrical section and having a downwardly flared and generally frustoconical section adjacent the lower end of said tapered section, said flared section defining a backing for said membrane when the latter is flexed upwardly by the pressure of said beverage, and said tapered section flexing downwardly and outwardly and sealing against said tube when the latter is inserted into said bore beyond said cylindrical section.

7. The combination defined in claim 6 in which said membrane includes an outer periphery joined to said bore adjacent the lower end of said downwardly flared section.

8. The combination defined in claim 7 in which the outer periphery of said membrane is of predetermined thickness, said membrane having a central area of greater thickness, the diameter of said tube being substantially less than the diameter of said outer periphery thereby to cause said membrane to tear in the region of said outer periphery.

9. The combination defined in claim 8 in which the upper side of said membrane is convex, the lower side of said membrane being substantially planar.

* * * * *